United States Patent [19]

Malan et al.

[11] 4,135,521

[45] Jan. 23, 1979

[54] TOBACCO PRODUCTS AND METHODS FOR THEIR PREPARATION

[75] Inventors: Johannes D. Malan; Jacobus C. Thirion, both of Stellenbosch, South Africa

[73] Assignee: Tobacco Research & Development Institute Limited, Zug, Switzerland

[21] Appl. No.: 776,885

[22] Filed: Mar. 11, 1977

[30] Foreign Application Priority Data

Jun. 17, 1976 [ZA] South Africa ..... 763603

[51] Int. Cl.[2] ..... A24B 3/12

[52] U.S. Cl. ..... 131/141; 131/17 R; 131/140 R

[58] Field of Search ..... 131/17, 15, 143, 141, 131/140; 195/27

[56] References Cited

U.S. PATENT DOCUMENTS 940,181 11/1909 Montag ..... 131/141

2,164,255 6/1939 Owen ..... 195/27

OTHER PUBLICATIONS

Tobacco Science issue of 10/1/1971 pp. 41–43 by Koiwai et al., a "Studies of Fermentation of Tobacco Part II; a Study of Variations in Fermentations Procedures and its Effect on Total Particulate Matter and Benzo (A) Pyrene".

*Primary Examiner*—Robert W. Michell
*Assistant Examiner*—V. Millin
*Attorney, Agent, or Firm*—Cushman, Darby & Cushman

[57] ABSTRACT

A method of upgrading a first batch or mass of tobacco which comprises fermenting another tobacco batch or sample in an aqueous medium to which has been added a suitable carbohydrate with an alcohol producing yeast, is characterized by utilizing material from the resultant liquid medium to upgrade the first batch of tobacco. The resultant liquid itself or an extract thereof may be utilized.

8 Claims, No Drawings

TOBACCO PRODUCTS AND METHODS FOR THEIR PREPARATION

This invention relates to a method for preparing tobacco products, and products so prepared. In particular, it relates to the preparation of a tobacco product having an enhanced flavour and aroma.

In the manufacture of tobacco products such as smoking, snuff and chewing tobacco, it is known to enhance the flavour and aroma by the use of various natural or synthetic additives which have a desired flavour or aroma, or produce a desired flavour or aroma when consumed. This enhancement is referred to hereinafter as upgrading, and a tobacco so enhanced as upgraded.

It has also already been proposed to recover aroma substances from tobacco by fermenting parts of the tobacco plant with an alcohol producing yeast, passing the off-gases from the fermentation step through a bed of activated carbon and desorbing the aroma substances that have been absorbed and adsorbed on to the bed of carbon. The prior proposal does not give a use for the product thus obtained, but it is safe to assume that it could be used to upgrade tobacco.

The present invention provides a method of upgrading a first batch or mass of tobacco which comprises fermenting another tobacco batch or sample in an aqueous medium to which has been added a suitable carbohydrate with an alcohol producing yeast, characterised by utilizing material from the resultant liquid medium to upgrade the first batch of tobacco.

The material which is utilized may be the resultant liquid itself, after suitable purification, or an extract prepared from the liquid.

The extract may be prepared by means of a liquid-liquid extraction utilizing a suitable solvent which is not miscible with water or by means of a stripping column.

It is preferred to use a sugar such as sucrose, glucose or fructose as the carbohydrate. The solution is usually brought to a strength of between 15 and 25% by weight of sugar. The amount of tobacco added is such that a slurry which can be handled by available pumping equipment is formed.

The origin of the sugar may also provide additional flavouring substances to be passed on to the upgraded tobacco. Thus if maple sugar is used, the resultant liquor has a distinct maple flavour. If molasses is used, the molasses flavour gets carried over.

EXAMPLE 1

In a number of experiments 10 k of each of a variety of tobacco samples was mixed with 100 l of a 20% sugar solution to form a slurry which was easy to handle and pump. To this slurry was added 25 g of a dry yeast mixed with one liter of water. The yeasts *Sacchromyces Ceriviceae* and *Sacchromyces Ceriviceae* var. *Beticus* were tried in separate experiments with similar results.

Fermentation was carried out at room temperature or where that temperature was too low at a temperature of between 18° C. and 25° C.

When fermentation is complete, the slurry is filtered to produce the resultant liquor. In some experiments the resultant liquor was centrifuged to remove all suspended particles which have passed through the filter.

These experiments have been carried out on a variety of tobacco samples such as Virginia Tobacco, Oriental Tobacco, Burley Tobacco, air dried tobacco, cigar type tobacco, Javanese Tobacco, French Tobacco, Brazilian Tobacco and green tobacco. In each case expert tobacco blenders pronounced that the liquor had the characteristic flavour and aroma of the original sample. Where maple sugar was used, they also were satisfied that the maple flavour and aroma had been extracted.

Many of these blenders insisted on putting the process into operation into their factories immediately. Indeed, the process is now in operation in a number of places around the world in that the resultant liquor, either after filtration or after centrifuging, is sprayed on to tobacco in tobacco preparation plants.

EXAMPLE 2

It may however, not always be suitable to spray the liquor as such on to tobacco. Often additives are dosed to tobacco in very small amounts amounting to a fraction of a percent of the tobacco by weight. For this type of operation it is desirable to provide the aroma and flavouring substances in more concentrated form. The yield of resultant liquor is usually between 80 and 85% by volume of the starting solution and on a large scale this can be quite a volume of liquid.

In separate experiments the resultant liquor (after centrifuging) was treated with a solvent (in this case methylene chloride) with the aid of a conventional liquid-liquid extractor and a conventional stripping column. The extracted liquid was treated in a vacuum to remove the solvent at 40° C.

From the stripping column the final yield of concentrate was between 1,0 and 3,0 per gram per liter of the resultant liquor, while liquid-liquid extraction yielded between 2,0 and 6,0 gram per liter. There was also a difference in the aroma and flavouring substance profile perceptible, but this could not be quantified. With the current state of the art it is impossible to quantify such a profile and one has to rely on the "nose" of expert tobacco blenders.

The extracts thus prepared have been used at rates of less than a fraction of a percent by weight to upgrade cigarette tobacco with outstanding results, according to the experts.

In some experiments it has been found that the flavour and aroma profile may be changed by regulating the pH at which extraction takes place, but this can also not be quantified.

By fractionating the extract it is also possible to obtain further flavour and aroma profiles. Thus fractionation has, for example, been done with distillation and steam distillation.

With the liquor or extracts or fractions of extracts of the invention it is possible to provide new flavour and aroma profiles in tobacco products. In addition it is possible to duplicate existing ones without resorting to synthetic flavouring substances. Thus tobacco flavours can be introduced in cigarettes where the basic tobacco is aroma deficient.

The main point is that the use of foreign or synthetic substances can be minimized to a large extent and that blenders can now utilize products of the tobacco plant to obtain a wide spectrum of flavour and aroma profiles.

They will, of course, be assisted in this if they use the small amounts of flavouring and aroma substances that can be recovered from the off-gases of the fermentation process, but it would probably not be worth the trouble and expense to recover these.

We claim:

1. A method of upgrading a first batch of tobacco comprising the steps of forming a second batch of tobacco into an aqueous slurry, adding a suitable soluble carbohydrate to the slurry, innoculating the slurry with an alcohol-producing yeast, allowing fermentation to go to completion; and utilizing material from the resultant liquid medium to upgrade the first batch of tobacco.

2. The method claimed in claim 1 in which the resultant liquid itself is used to upgrade the first batch of tobacco.

3. The method claimed in claim 1 in which an extract prepared from the resultant liquid is used to upgrade the first batch of tobacco.

4. The method claimed in claim 3 in which the extract is prepared by means of a suitable solvent which is subsequently evaporated to provide the extract.

5. The method claimed in claim 4 in which the solvent is methylene chloride.

6. The method claimed in claim 1 in which the carbohydrate is selected from the sugars sucrose, glucose and fructose, mixtures thereof and products containing them.

7. The method claimed in claim 6 in which the sugar solution has a strength of between 15 and 25° by weight.

8. The method claimed in claim 6 in which the yeast is of the genus Sacchromyces.

* * * * *